United States Patent [19]

Wessely

[11] 4,452,607

[45] Jun. 5, 1984

[54] PROCESS FOR DYEING SHRINKABLE TEXTILE FABRICS AND RESULTING DYED FABRICS

[75] Inventor: David A. Wessely, Windsor, England

[73] Assignee: Collins & Aikman Corporation, New York, N.Y.

[21] Appl. No.: 471,823

[22] Filed: Mar. 3, 1983

[30] Foreign Application Priority Data

Aug. 17, 1982 [GB] United Kingdom ..... 8223612

[51] Int. Cl.[3] ..... D06P 7/00

[52] U.S. Cl. ..... 8/497; 8/494; 8/922; 8/930

[58] Field of Search ..... 8/497, 494

[56] References Cited

U.S. PATENT DOCUMENTS 4,238,191 12/1980 Hussamy ..... 8/130.1
4,308,025 12/1981 Hussamy ..... 8/594

FOREIGN PATENT DOCUMENTS 1507633 4/1978 United Kingdom .
1531034 11/1978 United Kingdom .

OTHER PUBLICATIONS

Du Pont Technical Information Bulletin Q-1, "Dyeing and Finishing Warp Knit Fabrics of Qiana Nylon"-Jun. 1975.

Du Pont Technical Information Bulletin Q-3, "Knitting, Dyeing, and Finishing Weft Knits of Qiana Nylon"-Aug. 1976.

*Primary Examiner*—A. Lionel Clingman
*Attorney, Agent, or Firm*—Bell, Seltzer, Park & Gibson

[57] ABSTRACT

Fabrics formed at least partially of highly shrinkable fibers, such as polyester fibers, are dyed in a process which provides a number of significant economic and processing advantages over conventionally used dyeing processes, such as jet dyeing, producing a product with enhanced physical properties. The process involves first subjecting the fabric to a preparatory heat treatment step under conditions in which the fabric is allowed substantially complete freedom to relax and shrink, after which the fabric is wound onto a dye beam and beam-dyed. Following dyeing the fabric may be subjected to finishing operations, such as napping, and then to a tentering operation in which the fabric is stretched widthwise to restore a predetermined width, while being heated to a temperature greater than that used in the preparatory heat treatment step.

18 Claims, 1 Drawing Figure

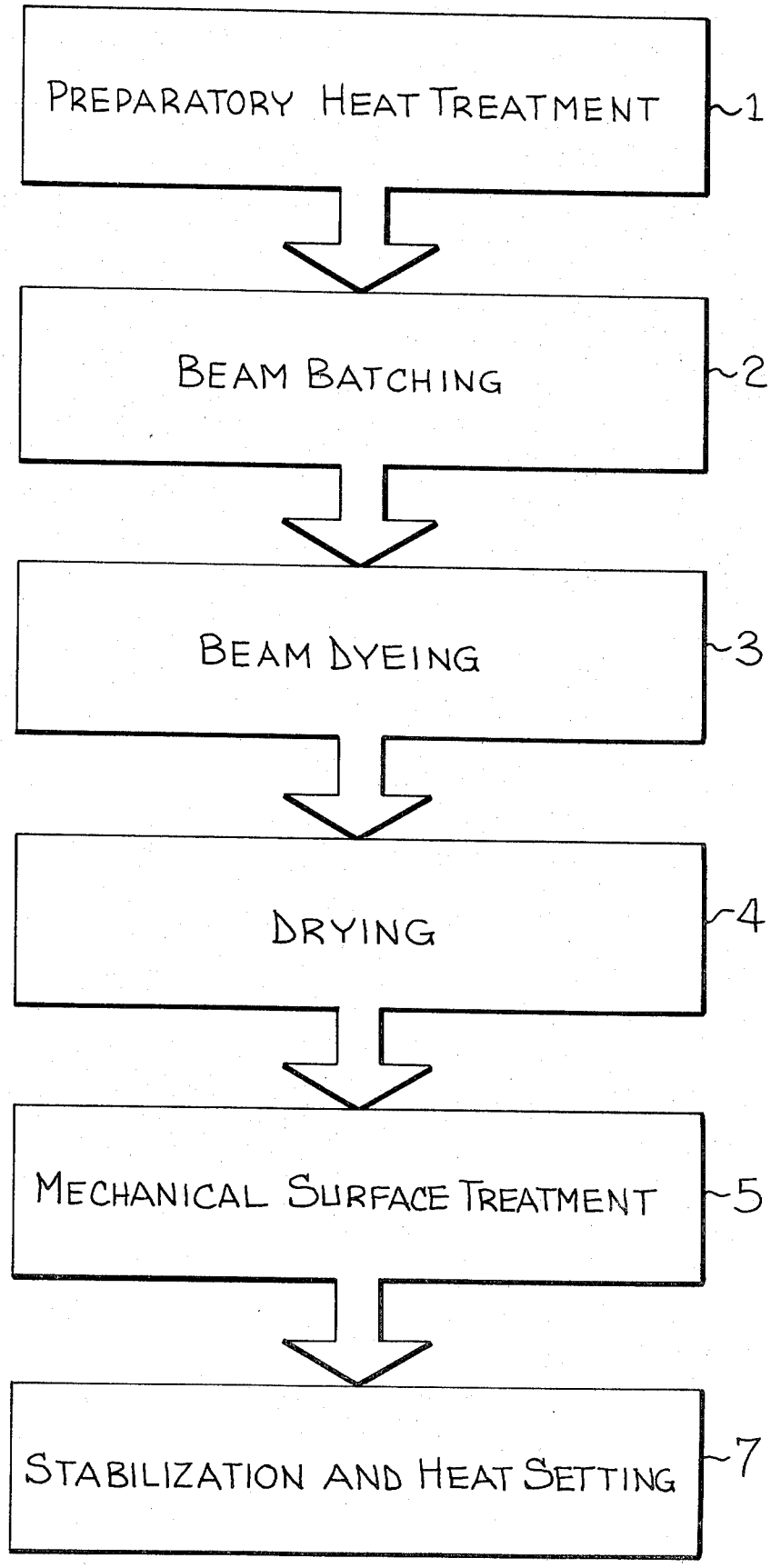
PREPARATORY HEAT TREATMENT
1
BEAM BATCHING
2
BEAM DYEING
3
DRYING
4
MECHANICAL SURFACE TREATMENT
5
STABILIZATION AND HEAT SETTING
7

PROCESS FOR DYEING SHRINKABLE TEXTILE FABRICS AND RESULTING DYED FABRICS

BACKGROUND OF THE INVENTION

This invention relates to an improved process for dyeing a textile fabric which contains shrinkable fibers, and more specifically, to a particularly advantageous and desirable process for beam dyeing polyester textile fabrics, especially polyester knit fabrics. The invention relates also to the dyed fabrics produced by this process.

Fabrics formed of polyester fibers, and polyester knit fabrics in particular, are susceptible to a comparatively high degree of shrinkage when the fabric is heated to elevated temperature during dyeing. Polyester knit fabrics are also highly subject to distortion and longitudinal stretching in the wet processing steps associated with dyeing.

A common method of dyeing polyester knit fabric is by jet dyeing. In jet dyeing, the fabric is handled in a rope-like manner as it is directed through the dye bath. The longitudinal pulling and stretching of the rope of fabric during processing causes a reduction in the width of the fabric, and this, together with the relatively high temperatures required for dyeing polyester fibers, contributes to substantial shrinkage of the fabric in the widthwise dimension. As a result, when the fabric is removed from the jet dyeing machine, it must be stretched widthwise on a tenter frame in order to bring the fabric back to the width desired in the finished fabric. During this tentering operation, the fabric is directed through a heating zone to effect heat setting of the fabric. It has been recognized that this type of heat setting imparts an undesirably harsh hand to the fabric, and it is usually necessary to subject the fabric to further mechanical surface treatment operations, such as napping, shearing, tigering, polishing and/or sanding, in order to alleviate the harsh hand and provide a fabric which is commercially acceptable. In some cases, such as in delicate knits for lingerie for example, the stretching and heating treatments necessary after jet dyeing may so alter the fabric properties as to render the fabric unsuited for its intended purpose. In addition to the disadvantages and limitations noted above, jet dyeing is restricted to relatively small dye lots, which thereby increases labor and energy costs, and increases the difficulty in producing uniform dye lots. Additionally, the very nature of the jet dyeing process involves numerous processing variables which make it quite difficult to obtain reproducible dye lots. More specifically, the jet dyeing process typically involves the simultaneous processing of several ropes of fabric through the jet dyeing apparatus. In order to achieve reproducible results within a given dye lot and from lot to lot, the ropes of fabric undergoing dyeing must be of equal weight, they must be traveling at the same speed through the machine and subjected to the same hydraulic forces, and they must receive the same amounts of dye liquor.

It has been recognized that the dyeing of textile fabrics by beam dyeing has certain advantages over the jet dyeing process described above. In beam dyeing, the fabric to be dyed is wound in open width on a perforated cylinder or beam for dyeing in a closed vessel. Not only does beam dyeing produce a more uniform or homogeneous color throughout a batch of fabric, and from one batch of fabric to the other, but beam dyeing permits dyeing of the fabric in larger batches, and is therefore a more economical process.

However, beam dyeing is used commercially mainly for dyeing relatively stable fabrics. Beam dyeing has not been successfully used heretofore for the dyeing of relatively unstable shrinkable fabrics formed of highly shrinkable fibers, such as polyester. One of the primary problems encountered in attempting to dye such fabrics by the beam dyeing method is their relative instability and the large degree of shrinkage which occurs during dyeing. At the temperature typically used for dyeing polyester fabrics, for example about 130° C., the fabric would shrink and contract about the dye beam to such an extent that the dye discharged through the beam could not penetrate through the thickness of the layers of fabric wound on the beam, producing uneven color and an unacceptable product.

In an effort to overcome these problems and make it possible to utilize beam dyeing for such fabrics, various attempts have been made to stabilize the fabric prior to the beam dyeing operation using treatment methods which would be expected to limit the amount of shrinkage during dyeing, such as for example by shrinking in a liquid bath or on a tenter frame. However, such prior efforts have been unsuccessful.

With the foregoing in mind, it is an object of this invention to provide a method by which textile fabrics formed of highly shrinkable fibers, such as polyester, can be successfully dyed by the beam dyeing method.

SUMMARY OF THE INVENTION

In accordance with the present invention, the textile fabric, prior to dyeing, and while in a substantially dry state, is subjected to a preparatory heat treatment operation under conditions in which the fabric is allowed substantially complete freedom to relax and shrink. More specifically, the preparatory heat treatment step involves directing the fabric, while in a substantially dry state, into a heating zone and advancing the fabric through the heating zone while maintaining the fabric in a substantially tensionless condition while contacting the fabric with a heated gas so as to effect substantially unrestricted longitudinal and widthwise shrinkage of the fabric. Once the fabric has been fully relaxed and shrunk in this manner, the dyeing operation is carried out.

Thus this invention now makes it possible to carry out the dyeing of highly shrinkable fabrics in a beam dyeing operation and to benefit from the economies of size and scale afforded by beam dyeing as compared to conventional jet dyeing methods. In addition to the advantages of beam dyeing noted earlier, it has also been found quite surprisingly that when fabrics are processed and dyed in accordance with the present invention, the subsequent finishing operations can be carried out much more effectively and efficiently than heretofore possible. For example, mechanical surface treatment of the fabric to achieve a desired surface effect can be accomplished with reduced mechanical energy input and with greater uniformity. Fabrics which have been processed in accordance with this invention have also been found to exhibit improved physical properties, such as stretch and set properties for example.

The benefits and advantages deriving from the preparatory heat treatment operation of this invention, while being particularly advantageous in connection with the beam dyeing of fabrics, can also be realized to some extent with other dyeing methods, such as jet dyeing for example.

During the preparatory heat treatment step, the textile fabric is subjected to a predetermined temperature for a sufficient period of time to relax the fabric to such an extent that any further shrinkage which may occur during the subsequent dyeing operation does not adversely affect that operation. The heat treatment step should preferably be carried out at a temperature of at least 100° C., and most desirably at a temperature higher than that utilized in the subsequent dyeing operation. The temperature must not, of course, be so high as to destroy the fabric. For fabrics formed of polyester fibers, the heat treatment step is preferably carried out at a temperature within the range of about 120° C. to about 180° C., and most desirably at a temperature of about 150° C.

The preparatory heat treatment operation is carried out by directing the fabric in an open width condition and in a substantially dry state into a heating zone formed by an enclosed chamber while maintaining the fabric in a substantially tensionless condition as it is advanced through the chamber. This is conveniently accomplished by advancing the open width fabric through the heating zone while the fabric is arranged in a series of tension-free suspended loops and while circulating a heated gas into contact with the fabric. Treatment time in the heating zone may typically range from about 20 seconds to about 10 minutes. For highly shrinkable polyester fabric constructions, these conditions may provide shrinkage of about 15% or greater lengthwise and about 12% or greater widthwise. Other more stable fabric constructions may provide shrinkage values of substantially less, such as about half these amounts. Suitable apparatus for handling the fabric in this manner is readily available from various manufacturers, including Fleissner GmbH of Germany and Stork Brabant B. V. of the Netherlands. Heating of the fabric in this apparatus may be carried by circulation of a heated gas, such as hot air, or preferably, by introduction of superheated steam into the heating chamber.

An optional additional step in preparing the fabric for dyeing involves framing the fabric before the perparatory heat treatment. This framing step is carried out using a conventional tenter frame for conveying the fabric at a prescribed width, temperature and exposure time. The purpose of this framing step is to remove random creases, folds, and imperfections in the fabric prior to the heat treatment. This process is carried out at a temperature lower than that used in the subsequent heat treatment zone and does not involve effecting a substantial degree of shrinkage of the fabric as occurs in the preparatory heat treatment step.

Following the preparatory heat treatment step, and the optional pre-framing step noted above, the fabric is stabilized and heat set at a temperature greater than that used in the preparatory heat treatment zone. This stabilization and heat setting is most conveniently carried out on a tenter frame, and may be performed either prior to or following dyeing.

Where the dyeing of the fabric is accomplished by beam dyeing, the fabric is prepared for dyeing by winding the fabric in open width about a perforated dye tube or beam. The beam is then placed in the dyeing vessel, the vessel is closed, and the dye bath is circulated through the layers of fabric wound on the beam. Under superatmospheric pressure, the temperature of the dystuffs is increased gradually to about 130° C. Typically, the dye bath is directed into the perforated core and then radially outwardly therefom through the layers of fabric. To insure uniform contact of the dye bath with the fabric, it is desirable to maintain a relatively low differential pressure of the dye bath across the beam.

After the beam dyeing is completed, the fabric may be subjected to subsequent processing, such as the application of chemical finishes, or mechanical surface treatments such as napping, shearing, tigering, polishing or sanding. It has been found that when such mechanical surface treatments are carried out following the heat treatment and dyeing operations, the fabric can be treated to impart a predetermined desired surface effect with less total mechanical energy than would be required for fabrics dyed by the processes of the prior art. Further, the surface treatment has been found to be more uniform throughout the fabric.

As an optional final step in the overall process, the dyed fabric is directed through a tentering operation to restore the fabric back to a predetermined desired width. This tentering operation involves engaging the fabric along its longitudinal edges and stretching the fabric widthwise back to a predetermined desired width dimension and while heating the fabric so as to set the fabric at this predetermined width. Typically, the fabric is heated to a temperature greater than that used in the preparatory heat treatment step. The resulting fabric exhibits significantly better stretch and set properties than fabrics processed by conventional jet dyeing methods.

DESCRIPTION OF ILLUSTRATIVE EMBODIMENT

The invention will be understood more fully from the following detailed description of one embodiment of the invention, when taken in connection with the accompanying block diagram.

Referring now more particularly to the diagram, a knit polyester fabric having a greige width of about 86 inches is subjected to a preliminary heat treatment step as indicated at 1 by advancing the fabric through a loop steamer/baker. In the steamer, the fabric is suspended from a series of moving rods and progresses through the apparatus in a succession of freely depending loops. The steamer contains an atmosphere of superheated steam at a temperature of 150° C. and subjects the fabric to this temperature for a period of about six to nine minutes as the fabric travels through the machine. Rapidly after entering the steamer, the fabric is observed to neck in widthwise and shrink lengthwise, and shrinkage continues without restriction to the major extent of the maximum obtainable shrinkage. Upon emerging from the steamer, the fabric has a width of about 75 inches, and has shrunk about 15% in the length dimension.

After discharge from the steamer the fabric may be folded or lapped into a cart so as not to restrict further ability of the fabric to shrink, and is thereafter fed to a beam batcher 2 where it is wound onto perforated beams or cylinders preparatory to delivery to a beam dyeing machine 3. In the beam dyeing machine, the relaxed or pre-shrunk fabric is beam dyed at a temperature of approximately 130° C. and the resulting batch is uniformly dyed throughout to an industrially acceptable color standard.

After beam dyeing, the fabric, then at a width of about 75 inches, is dried on a suitable dryer apparatus 4, prefinished, and then subjected to three passes on a napping machine 5. After napping, the fabric has a width of about 54–55 inches. The napped fabric is then stabilized and heat set in a tentering operation, indicated at 7, at a temperature of about 170° C. where the fabric is stretched widthwise to a uniform width dimension of about 60 inches.

EXAMPLES

The following examples are presented for the purpose of illustrating the invention, and are not to be understood as limiting.

EXAMPLE 1

A knitted textile fabric composed of 100% polyester fibers is processed as follows:

1. Treatment Before Dyeing

The textile fabric is arranged in a succession of loops and directed into and through a loop steamer in which the atmosphere is maintained at 150° C. by means of superheated steam vapor. After contact with the superheated steam vapor for a period of 7 minutes, the fabric is allowed to exit the machine where the fabric is accumulated prior to the subsequent dyeing process. The fabric shrinks 12.4% in the width direction and 20.7% in the length direction.

2. Dyeing

The above fabric is then placed onto a perforated steel cylinder in such a manner that the entire fabric mass may be exposed to liquid which is circulated within a vat which surrounds the fabric contained on the steel cylinder. A dyebath composed of the following is then introduced to the vat:

1.23% (owf) Disperse Orange 29
0.78% (owf) Disperse Blue 60
0.90% (owf) Disperse Red 60
1.23% (owf) Acetic Acid The dyebath is circulated within the vat and also heated at a rate of 3° C./minute to 120° C. and held at 120° C. for ½ hour. The dyebath is then cooled to ambient conditions and then allowed to drain from the machine. The vat is refilled with water and allowed to circulate through the fabric mass in order to remove residual chemicals, oils, fats, and waxes from the fabric and to otherwise render the fabric suitable for subsequent processing such as for the application of chemical finishes, napping, shearing, stabilization to washing.

EXAMPLES 2–12

In a manner similar to that described in Example 1, polyester knit fabrics are processed in a loop steamer under the conditions indicated in the table below, resulting in fabric shrinkage as indicated.

| Example No. | Superheated Steam Chamber - C | Dwell Time Seconds | % Shrinkage Width | % Shrinkage Length |
|---|---|---|---|---|
| 2 | 130 | 360 | 16.1 | 18.1 |
| 3 | 140 | 360 | 16.4 | 20.7 |
| 4 | 160 | 360 | 18.8 | 21.7 |
| 5 | 180 | 360 | 20.6 | 22.9 |
| 6 | 150 | 300 | 17.9 | 21.4 |
| 7 | 150 | 30 | 14.8 | 18.0 |
| 8 | 150 | 60 | 17.1 | 20.2 |
| 9 | 150 | 120 | 17.3 | 19.9 |
| 10 | 150 | 180 | 18.0 | 20.9 |
| 11 | 170 | 60 | 19.5 | 22.8 |
| 12 | 170 | 120 | 19.9 | 22.9 |

The above fabrics are then dyed according to the procedure outlined in Example 1.

EXAMPLES 13–18

An alternative preparation for dyeing involves the use of a drying device prior to dyeing, either before (pre-frame) or after (post-set) the superheated steam treatment. The drying device most commonly used is referred to as a frame and is routinely used in the textile industry for conveying fabrics at a prescribed width and temperature and exposure time. It is to be understood that the frame process is for the purpose of removing random creases and imperfections and alone is not sufficient for rendering the fabric dyeable as described in Example 1.

In examples 13–18 a 100% polyester knit fabric is subjected to a pre-frame operation at the temperature indicated below and then to a heat treatment step with superheated steam at the indicated temperature. The fabric is then dyed as in Example 1. In examples 19–24 a similar fabric is subjected successively to a heat treatment step and to a post-set step at the temperatures indicated, followed by dyeing as in Example 1.

| Example No. | Pre-Frame °C. | Superheated Steam Temperature - °C. | Post-Set °C. |
|---|---|---|---|
| 13 | 100 | 120 | — |
| 14 | 120 | 130 | — |
| 15 | 130 | 140 | — |
| 16 | 120 | 150 | — |
| 17 | 120 | 150 | — |
| 18 | 130 | 150 | — |
| 19 | — | 120 | 130 |
| 20 | — | 130 | 140 |
| 21 | — | 140 | 150 |
| 22 | — | 150 | 155 |
| 23 | — | 150 | 160 |
| 24 | — | 150 | 160 |

EXAMPLE 25

A polyester knit fabric is subjected to a preframe operation at 120° C. on a tenter frame, then to a relaxed heat treatment step in a loop steamer with superheated steam at 140° C., followed by a post set operation at 170° C. The fabric shrinkage was 6.5% in the length and 12.4% widthwise. The thus processed fabric is then dyed as in Example 1.

In the specification, drawings and examples, there are set forth specific illustrative embodiments of the invention, and while specific terms are employed to aid in understanding the invention, they are used in a generic and descriptive sense only and not for purposes of limitation.

That which is claimed is:

1. A process for dyeing a textile fabric containing shrinkable polyester fibers, comprising directing the textile fabric in a substantially dry state into a heating zone and advancing the fabric through the heating zone while contacting the fabric with a heated gas and while maintaining the fabric in a substantially tensionless unrestrained condition both lengthwise and widthwise so as to effect substantially unrestricted longitudinal and widthwise shrinkage of the fabric, and thereafter dyeing the thus shrunken textile fabric.

2. A process as set forth in claim 1 wherein the heated gas is at a temperature greater than 100° C.

3. A process as set forth in claim 1 wherein the heated gas comprises superheated steam.

4. A process as set forth in claim 1 wherein the dyeing of the fabric is carried out at a temperature less than that used in said heating zone.

5. A process as set forth in claim 1 wherein said step of directing the fabric through a heating zone comprises transporting the fabric in open width through the heating zone while arranged in a series of tension free suspended loops and while contacting the fabric with a heated gas to heat the fabric and thus effect free shrinkage thereof.

6. A process as set forth in claim 1 including the further step of tentering the fabric following treatment in the heating zone to restore a predetermined substantially uniform width dimension to the fabric.

7. A process as set forth in claim 6 wherein said step of tentering the fabric comprises engaging the fabric along its longitudinal edges and stretching the fabric widthwise while heating the fabric to a temperature greater than that used in said heating zone.

8. A process as set forth in claim 6 wherein said tentering step is carried out prior to dyeing.

9. A process as set forth in claim 6 wherein said tentering step is carried out after dyeing.

10. A process as set forth in claim 1 including the further step of subjecting the fabric to a mechanical surface treatment operation after said step of dyeing to modify the surface appearance of the fabric.

11. A process for dyeing a textile fabric containing shrinkable polyester fibers, comprising directing a substantially dry textile fabric in an open width condition into a heating zone and advancing the fabric through the heating zone while contacting the fabric with a heated gas and while maintaining the fabric in a substantially tensionless unrestrained condition both lengthwise and widthwise so as to effect substantially unrestricted longitudinal and widthwise shrinkage of the fabric, removing the fabric from the heating zone and winding the thus shrunken fabric on a dye beam, placing the beam of fabric in a beam dyeing chamber and circulating dyestuffs through the layers of fabric wound on the beam and dyeing the fabric.

12. A process as set forth in claim 11 wherein the step of heating the fabric comprises contacting the fabric with superheated steam at a temperature of about 120° C. to about 180° C. for a period of about 20 seconds to about 10 minutes.

13. A process as set forth in claim 11 including the further step, performed after the fabric is removed from said heating zone and prior to winding of the fabric on the dye beam, of further heating the fabric while engaging the fabric along its longitudinal edges and maintaining a predetermined distance therebetween to impart a predetermined width to the fabric.

14. A process for dyeing a textile fabric containing shrinkable polyester fibers, said process comprising transporting an open width polyester textile fabric through a heating zone while arranged in a series of tension free suspended loops and contacting the fabric with a heated gas to heat the fabric and effect substantially unrestricted longitudinal and widthwise shrinkage of the fabric, removing the thus shrunken fabric from the heating zone and thereafter winding the fabric on a dye beam, dyeing the beam of fabric, removing the fabric from the dye beam, and tentering the fabric to restore a predetermined substantially uniform width dimension thereto, said tentering step comprising engaging the fabric along its longitudinal edges and stretching the fabric widthwise while heating the fabric to a temperature greater than that used in said heating zone to stabilize and set the fabric.

15. A process for dyeing a textile fabric which is formed at least partially of shrinkable polyester fibers, said process comprising transporting an open width polyester textile fabric through a heating zone while arranged in a series of tension free suspended loops and contacting the fabric with a heated gas to heat the fabric and effect substantially unrestricted longitudinal and widthwise shrinkage of the fabric, removing the thus shrunken fabric from the heating zone and tentering the fabric to restore a predetermined substantially uniform width dimension thereto, said tentering step comprising engaging the fabric along its longitudinal edges and stretching the fabric widthwise while heating the fabric to a temperature greater than that used in said heating zone to stabilize and set the fabric, thereafter winding the fabric on a dye beam and dyeing the beam of fabric.

16. A process for dyeing a textile fabric containing shrinkable polyester fibers, said process comprising transporting an open width polyester textile fabric through a heating zone while arranged in a series of tension free suspended loops and contacting the fabric with superheated steam at a temperature of about 120° C. to about 180° C. for a period of about 20 seconds to about 10 minutes to heat the fabric and effect shrinkage of at least about 15% in the longitudinal direction and at least about 12% widthwise, removing the thus shrunken fabric from the heating zone and thereafter winding the fabric on a dye beam, placing the beam of fabric in a beam dyeing chamber and dyeing the fabric under superatmospheric pressure.

17. A dyed textile fabric produced by a process as set forth in any one of claims 1, 10, 11, 14, 15 or 16.

18. A process for dyeing a textile fabric containing shrinkable polyester fibers, said process comprising transporting an open width polyester textile fabric through a heating zone while maintaining the fabric in open width and in a substantially tensionless unrestrained condition both lengthwise and widthwise and while heating the fabric so as to effect substantially unrestricted longitudinal and widthwise shrinkage of the fabric, removing the thus shrunken fabric from the heating zone and thereafter winding the fabric on a dye beam, placing the beam of fabric in a beam dyeing chamber and circulating dyestuffs through the layers of fabric wound on the beam and dyeing the fabric.

* * * * *